United States Patent [19]

Rosenwald

[11] Patent Number: 4,715,140

[45] Date of Patent: Dec. 29, 1987

[54] COMPENSATOR FOR HANDGUNS AND THE LIKE

[76] Inventor: Fred Rosenwald, 148 W. Julianna Dr., Churchville, Pa. 18966

[21] Appl. No.: 26,733

[22] Filed: Mar. 17, 1987

Related U.S. Application Data

[63] Continuation-in-part of Ser. No. 787,157, Oct. 15, 1985, abandoned.

[51] Int. Cl.[4] ..... F41C 21/18; F41F 17/12

[52] U.S. Cl. ..... 42/97; 89/14.3

[58] Field of Search ..... 89/14.3, 163, 196; 42/97

[56] References Cited

U.S. PATENT DOCUMENTS

| | | | |
|---|---|---|---|
| 2,464,010 | 3/1949 | Vonella | 89/14.3 |
| 2,935,000 | 5/1960 | Mowrey | 89/14.3 |
| 3,115,060 | 12/1963 | Ashbrook et al. | 89/14.3 |
| 3,365,829 | 1/1968 | Shockey | 42/97 |
| 4,057,003 | 11/1977 | Atchisson | 89/14.3 |
| 4,127,056 | 11/1978 | Kart | 89/196 |

OTHER PUBLICATIONS

Libourel, Lutz Muzzle Weight, Oct. (1986), p. 93, of Gun and Ammo.

*Primary Examiner*—Stephen C. Bentley
*Assistant Examiner*—Stephen M. Johnson
*Attorney, Agent, or Firm*—Louis Weinstein

[57] ABSTRACT

A compensator for a handgun comprises a barrel bushing having a first end inserted into the forward end of a slide and slidably receiving the barrel, and a second end projecting away from the barrel and slidably receiving a compensator weight having an external shape which conforms to and forms an extension of the slide. A bias spring mounted in the chamber beneath the barrel has a spring rod extending therethrough, the forward end of which projects into an opening in the lower end of the compensator weight. A projection on the barrel bushing retains a spring plug, slidably mounted on the spring rod, in a position to preload the spring and normaly urge the compensator weight toward the barrel. At least one threaded member provided in the compensator weight secures the compensator weight to the spring rod to prevent the compensator weight from experiencing either axial of rotational movement relative to the spring rod. The compensator weight adds significant weight to the forward end of the handgun, and well in front of the barrel to significantly reduce recoil resulting from the firing of the handgun. The compensator weight, appearance and shape permits the handgun to be placed within and easily withdrawn from a standard hip-mounted holster. The barrel bushing increases the drag between the barrel and slide, futher contributing to a reduction in the recoil action. The mounting of the compensator weight assembly upon the handgun is simple and straight-forward and requires no modification of the handgun components and further may be easily and readily disassembled from the handgun enabling the handgun to be returned to its normal configuration. The weight compensator may also be provided with exhaust ports for enabling blast gas to exit upwardly through the bushing and compensator weight, which further serves to reduce recoil.

8 Claims, 7 Drawing Figures

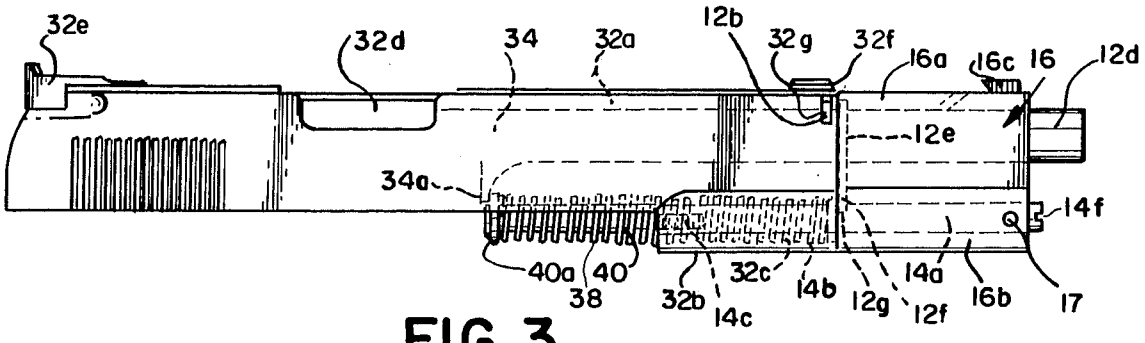
FIG. 3
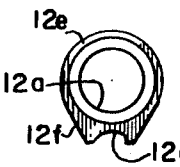
FIG. 4b
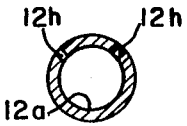
FIG. 4c
FIG. 4d
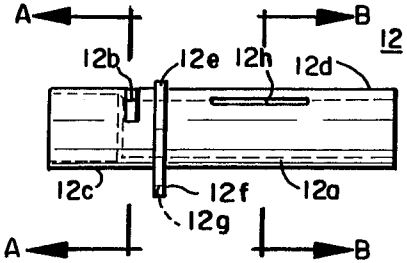
FIG. 4a

COMPENSATOR FOR HANDGUNS AND THE LIKE

This application is a continuation-in-part of copending application Ser. No. 787,157 filed Oct. 15, 1985, now abandoned.

FIELD OF THE INVENTION

The present invention relates to apparatus for reducing the recoil of a weapon and more particularly to novel compensator apparatus for handguns including a compensator weight for reducing recoil.

BACKGROUND OF THE INVENTION

The firing of a handgun is accompanied by a recoil action which manifests itself in the form of a sudden upward movement of the handgun, jerking the handgun away from the target. This is extremely disadvantageous especially when it is desirous to repeatedly fire the handgun in rapid succession, the recoil action requiring that the handgun be rapidly returned to the desired position and steadied in order to be assured that the next projectile to be fired will strike the target at the desired location.

It is further desired to provide a handgun having reduced recoil action and which is capable of being housed in a conventional hip-mounted holster without modification of the holster and further being capable of being rapidly drawn from said holster.

BRIEF DESCRIPTION OF THE INVENTION

The present invention overcomes the disadvantages of the conventional handgun with or without conventional compensator apparatus and achieves the above-mentioned objectives through the employment of a compensator assembly which is characterized by comprising a compensator weight slidably mounted upon a barrel bushing, said bushing having a rearward portion extending into the hollow region between the outer diameter of the barrel and inner diameter of the slide of the handgun, a forward portion which slidably receives the compensator weight and a central portion which is releaseably locked to the slide by means of a bayonet type mount and which preloads the recoil reducing spring.

The compensator weight slidably receives the forward end of the bushing and the forward end of a spring rod and is secured to the spring rod by a threaded fastener.

The barrel bushing moves together with the slide whereas the compensator weight is locked to the spring rod, permitting some linear movement while preventing rotational movement of the compensator weight about the longitudinal axis of the spring rod.

When the handgun is fired, detonating the charge, the rapidly expanding gases urge the round from the barrel. The casing is separated from the round and attempts to move to the rear, pushing the slide rearwardly. The inertia of the slide moving back causes the normally rearwardly biased compensator weight to move forward. The spent casing is expelled from the handgun at this time. The preloaded recoil reducing spring is further charged by the rearward movement of the slide and forces the slide to halt its rearward movement and thereafter rapidly returns the slide to the battery position. The barrel bushing imparts drag to the slide, due to the fit and relative movement therebetween, further aiding in the reduction of recoil.

The weight added to the forward end of the barrel by the compensator weight provides a still further and significant reduction in the recoil of the handgun.

If desired, both the barrel bushing and compensator weight may be provided with gas ports aligned in such a manner as to expel the gases expanded during the firing of a round through the ports at an angle relative to the longitudinal axis of the barrel to further compensate for and counteract handgun recoil.

The compensator weight is designed to closely conform to the shape of the handgun, providing an aesthetically pleasing appearance. The entire compensator weight assembly may be assembled and disassembled in a simple, straight-forward manner and none of the components of the compensator assembly need be permanently secured to the handgun to permit the handgun to be easily returned to its unmodified state. The extended length of the handgun having the compensator weight assembly mounted thereto is rather modest, enabling the insertion and rapid withdrawal of the handgun from a standard hip-mounted holster, while at the same time, providing a significant reduction in recoil.

OBJECTS OF THE INVENTION A BRIEF DESCRIPTION OF THE FIGURES

It is therefore one object of the present invention to provide a novel compensator weight assembly for handguns and the like.

Still another object of the present invention is to provide a novel compensator weight assembly for handguns and the like to significantly reduce the effects of recoil upon the handgun.

Still another object of the present invention is to provide a novel compensator weight assembly for use with handguns and the like which assembly may be readily assembled upon and disassembled from the handgun without modification of any of the conventional handgun parts.

Still another object of the present invention to provide a novel compensator weight assembly for handguns and the like in which the compensator weight is supported and slidably mounted relative to the handgun slide and is fixedly mounted relative to the spring system spring rod and is linearly movable against a spring force exerted by the recoil reducing spring.

Still another object of the present invention is to provide a novel compensator weight assembly for use in handguns and the like and which is further provided with exhaust ports for further reducing the effective recoil, especially in applications where it is desired to accurately fire the handgun in rapid fire fashion.

The above as well as other objects of the present invention will become apparent when reading the accompanying description and drawing, in which;

FIG. 3 shows a plan view of the assembly of FIG. 1.

Figure 1:
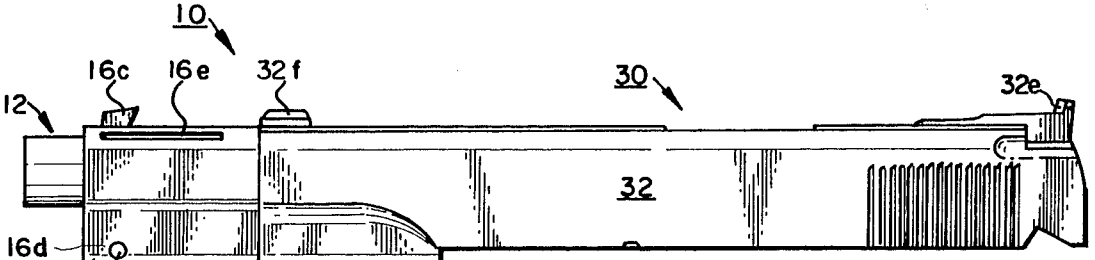
FIG. 1 shows a perspective view of the compensator assembly of the present invention mounted upon a handgun, only a portion of the handgun being shown in FIG. 1 for purposes of simplicity.
Figure 2:
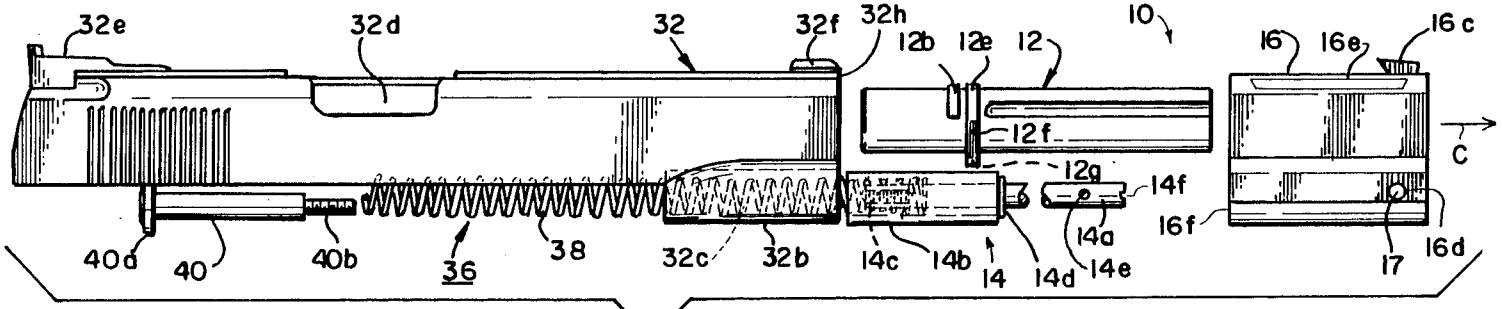
FIG. 2 shows an exploded view of the arrangement of FIG. 1.

FIG. 4*a* shows a plan view of the barrel bushing employed in the assembly as shown in FIGS. 1 through 3.

FIGS. 4*b* and 4*c* show sectional views of the barrel bushing of FIG. 4*a* looking at the direction of arrows A—A and B—B respectively.

FIG. 4*d* shows a right-hand end view of the barrel bushing of FIG. 4*a*.

DETAILED DESCRIPTION OF THE INVENTION

Considering FIGS. 1-3, the compensator assembly 10, whose components are shown in exploded fashion in FIG. 2, is adapted for assembly upon a handgun 30 (FIG. 1), only a portion of the components of the handgun 30 being shown in the figures for purposes of simplicity.

Noting especially FIGS. 1, 2, and 4*a*–4*d*, compensator assembly 10 of the present invention is comprised of a compensation weight carrier also referred to as a barrel bushing 12, a modified spring guide rod 14 and a compensator weight 16. The components of the handgun 30 shown in the aforementioned figures include the slide 32 having a first bore **32*a* for slidably receiving barrel 34 and having a second bore 32*c* provided in downwardly extending slide portion 32*b* for slidably receiving spring rod plug 14*b*** in a manner to be fully described.

Elongated opening **32*d* in slide 32 (see FIGS. 1 and 2) provides for ejection of a spent shell (not shown) which is automatically ejected from handgun 30** during a firing operation.

Rear projection **32*e* cooperates with forward projection 32*f*, both of which are aligned along the upper surface of 32**, for the purpose of aiming the handgun at a target to facilitate accurate firing.

As is conventional in such handguns, such as, for example, 45 caliber handguns, slide 32 is movable relative to barrel 34. A spring system 36 comprised of elongated helical spring 38; rearward shaft 40 whose left-hand **40*a* engages a downwardly projecting portion 34*a* of barrel 34; and spring rod 14*a*, cooperate to provide for counteracting the rearward movement of slide 32 during a firing operation and thereafter for rapidly returning slide 32** to the battery position, as will be described in greater detail hereinbelow.

Compensator weight 16 has a substantially uniform oval-shaped cross-section over its length and is provided with an upper bore **16*a* for slidably receiving the forward end of barrel bushing 12; and a lower bore 16*b* for slidably receiving the right-hand end of spring rod 14*a*. Projection 16*c* may be used in cooperation with projection 32*b* on slide 32 for aiming purposes, the increased distance between projections 16*c* and 32*e*** serving to improve the aiming accuracy of the handgun.

A pair of openings **16*d* each receive a set screw 17 which extends through said openings in compensator weight 16 and in spring rod 14*a* to rigidly secure compensator weight 16 to the rod 14*a* and prevent any rotational movement of compensator weight 16 relative to the handgun and specifically the longitudinal axis at barrel 34 and to prevent linear movement of compensator weight 16 relative to spring rod 14*a***.

Barrel bushing 12, shown best in FIGS. 1 and 4*a*–4*d*, is provided with a hollow interior bore **12*a* for slidably receiving the forward end of barrel 34 and to permit passage of a round therethrough. An arcuate-shaped projection 12*b*, provided along the rearward portion 12*c* of barrel bushing 12, cooperates with an arcuate-shaped recess 32*g* provided along the interior wall of bore 32*a* to form a bayonet-type locking arrangement between barrel bushing 12 and slide 32**.

A substantially circular-shaped projection **12*e* surrounds the periphery of barrel bushing 12. The lower portion 12*f* extends downwardly and is provided with an arcute-shaped surface 12*g* designed to embrace the right-hand shoulder 14*d* of spring plug 14*b* to prevent movement of the barrel bushing 12 when the compensator weight assembly 10 is mounted in the operative position upon the handgun 30 as well as preloading spring 38**, as will be more fully described.

A pair of elongated slots **12*h*, 12*h* are provided in the forward portion 12*d* of barrel bushing 12 and cooperate with a similar pair of slots or ports 16*e*, 16*e* shown in FIGS. 1 and 2 are aligned with slots 12*h*, 12*h* respectively, in bushing 12** to provide outlet ports for exiting gases generated during the firing operation, for a purpose to be more fully described.

The compensator weight assembly 10 is mounted upon the handgun 30 in the following manner;

The spring rod (not shown) typically provided in a conventional handgun is removed. The barrel bushing (not shown) typically provided within a conventional handgun is also removed. Barrel bushing 12 is inserted into the forard end of slide 32. Projection **12*b*** (FIG. 4*b*) is aligned with recess **32*g* in slide 32 and the barrel bushing 12 is twisted though approximately a quarter turn to place the bayonet-type locking assembly, formed by bushing 12 and slide 32**, in the locked position.

The modified spring rod **14*a*, which is modified so as to be greater in length than the spring rod typically provided in a conventional unmodified handgun, is inserted through bore 32*c* in slide 30 so that the tapped opening 14*c* provided at the left-hand end of spring rod 14*a* threadedly engages the threaded right-hand end 40*b* of spring guide rod 40. The right-hand end of rod 14*a* has a groove 14*f* for receiving the tip of a screw driver for tightening or loosening the rod 14*a*. Helical return spring 38 is slidably mounted upon rod extension 14*a* and spring guide rod 40. Hollow cylindrical spring plug 14*b* is slidably mounted upon modified spring rod 14*a***.

The inner diameter of spring plug **14*b* is sufficiently large to slidably receive helical spring 38. The right-hand end of spring plug 14*b* is provided with a shoulder 14*d* of reduced diameter. The interior of shoulder 14*d* engages the right-hand end of helical spring 38**.

Spring plug **14*b* is moved to the left, relative to FIG. 2, for example, by a distance sufficient to move the right-hand end of plug 14*b* to align shoulder 14*d* with the recess 12*g* in projection 12*f* to retain spring plug 14*b* in a position to preload spring 38. The curved recess 12*g* in projection 12*f* on bushing 12 embraces the upper portion of the shoulder 14*d* of spring plug 14*b***.

Preloaded spring 38 has its left-hand end engaging the head **40*a* of rod 40 and its right-hand end engaging the interior of shoulder 14*d* of spring plug 14*b*, to urge spring rod 40 to the left, relative to FIG. 2, thereby urging the left-hand end of spring rod head 40*a* into engagement with the integral projection 34*a* of barrel 34. When it is mounted on rod 14*a*, compensator weight 16 may, however, be moved to the right by exerting a force on compensator weight 16 greater than the force of spring 38** and in the direction shown by arrow C.

The compensator weight 16 is then slidably mounted upon the forward end **12*d* of bushing 12 and the forward end of spring rod 14*a* and the compensator weight 16 is pushed rearwardly until its rearward end 16*f* engages the forward end 32***h* of slide 32 (see FIGS. 1 and 2). Set screw 17, extends through aligned openings 16*d* on opposite sides of compensator weight 16 and near the forward end 16*g* and also extends through opening 14*e* in modified rod 14*a* which opening 14*e* is aligned with openings 16*d*, 16*d*. One end of set screw 16 preferably threadedly engages a tapped opening provided in one of the openings 16*d*, 16*d*, thus locking compensator weight 16 to the spring rod assembly so that it is stationary with respect to members 14 and 40, while being linearly movable relative to barrel 34 upon exertion of a force of sufficient magnitude to overcome the force of spring 38. It can be seen from the foregoing that the compensator weight assembly 10 may be easily and readily mounted to the handgun 30 and maybe disassembled in an equally simple and straight-forward fashion. It should further be noted that none of the components of the conventional handgun require any modification in order to properly mount the compensator weight assembly 10 upon the handgun.

The compensator weight assembly 10, once mounted upon the handgun in the manner described hereinabove, operates as follows:

The firing operation is initiated by pulling the handgun trigger (not shown) causing the firing pin (not shown) to strike the casing thereby initiating an explosion which develops a blast of gaseous matter sufficient to urge the round (not shown) forwardly through barrel 34 and ultimately out of the front end of the handgun 30, including bushing 12 and the compensator weight 16. Simultaneously therewith, the slide 32 moves rearwardly due to the expanding blast gases. Slide 32 moves rearwardly relative to barrel 34 and member 40. Barrel bushing 12 moves with the movement of slide 30 causing projection 12*f* to move spring plug 14*b* to the left. The interior of the shoulder 14*d* of plug 14*b*, which engages the right-hand end of spring 38, causes spring 38 to be further charged. The force needed to compress spring 38 also serves to reduce the rearward movement of slide 32. The tendency of the handgun, which is held in the hand of the operator, is for the forward end of the barrel 32 to move upwardly and in a direction lateral to the path of the round which has just been fired. The inertia of the slide 32 abruptly moving rearwardly causes the compensator weight 16, although normally urged to the left, by spring 38 and modified spring rod 14*a*, to move forward. During the rearward movement of slide 32 the spent casing is expelled and spring 38 is fully charged, the charged spring 38 thereafter forcing slide 32 to rapidly return to the battery position, placing the handgun in readiness to be fired again.

The forward movement of the compensator weight 16 together with the effect of the weight of the compensator weight 16 arranged forward of the front of the handgun 30, serves as a moment arm to significantly reduce the recoil action, i.e. the tendency of the forward end of the handgun 30 to abruptly move upwardly.

Further reduction of the recoil action is obtained by the cooperating slots 12*h*, 12*h* in barrel bushing 12 and ports 16*e*, 16*e* in compensator weight 16 which enable the blast gas following behind the round to exit in diagonally upward directions, i.e. upward to the left and upward to right through ports 16*e*, 16*e*, 16*e* which collectively act to urge the forward end of the handgun 30 downwardly and thereby counteract and compensate for the upward movement of the forward end of the handgun during the firing operation.

The compensator weight 16, which is preferably formed of a high density, case-hardened steel, provides remarkable recoil compensation sufficient to permit its use in the absence of the compensator ports 16*e*, 16*e*. Providing a compensator weight which has a uniform cross-section over its length and which conforms with the forward cross-section of the forward end of slide 32, provides the dual function of adding significant weight to the forward end of the handgun and provides the handgun with a forward end which is in conformity with the conventional forward end of the handgun, thus providing an aethestically pleasing appearance, thereby yielding a handgun which neither looks nor handles like a "hybridized" handgun. Judicious placement of the set screw 17 at the forward end of the compensator weight 16 further adds to the total weight of the compensator, increasing the moment arm by placement of the set screw 17 at a location which is furthest removed from the forward end of the handgun. The set screw may also be formed of high density steel to further increase the weight of the compensator weight.

As was mentioned hereinabove, barrel bushing 12 slidably receives the forward end of barrel 34. This slidable engagement imparts drag from the barrel bushing to the slide, thereby further reducing the recoil movement of slide 32.

Tests of a handgun of the 45 caliber type fitted with the compensator weight assembly of the present invention have shown that the recoil action is remarkably reduced. In addition, the design of the compensator weight assembly does not distract from the aesthetic appearance of the handgun and further permits the handgun to be carried within conventional hip-mounted holsters and further to be quickly withdrawn from such holsters, which is an extremely important characteristic for competition and especially those competitive activities which require a rapid draw from a holster and/or rapid firing of the handgun.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed:

1. A compensator assembly for a handgun comprising a barrel, a slide surrounding and reciprocally movable relative to said barrel, a spring return system including a spring whose forward end extends at least partially into a lower opening in said slide, said compensator assembly comprising:

a hollow bushing having a rearward portion extending into and releaseably coupled to said slide and surrounding and slidably receiving the forward portion of said barrel;

a spring guide rod for said spring return system extending through the lower opening in said slide and through said spring;

projection means on said bushing extending towards said spring guide rod;

said barrel having a projection;

means slidably mounted on said guide rod and engaging said bushing projection means and said spring for charging said spring to normally urge one end of the guide rod into engagement with said barrel projection;

a compensator weight having an upper bore slidably receiving the forward end of said bushing and having a lower bore receiving the forward end of said guide rod; and fastening means for securing said compensator weight to said guide rod to prevent said guide rod and compensator weight from experiencing linear movement relative to one another, said projection means preventing rotational movement of said bushing and holding said slidably mounted means in a position to preload said spring.

2. The compensator assembly of claim 1 wherein the cross-sectional shape of said compensator weight substantially conforms to the cross-sectional shape of said slide and is substantially uniform over the length of the compensator weight to provide the compensator weight with an appearance which is substantially similar to the appearance of the forward end of said slide.

3. The compensator assembly of claim 1 wherein the forward end of said compensator weight is provided with an upwardly extending projection which cooperates with a projection on said slide to facilitate aiming of the handgun.

4. The compensator assembly of claim 1 wherein said compensator weight is formed of high density steel.

5. The compensator assembly of claim 1 wherein said bushing is provided with a projection and said slide is provided with a cooperating groove to form a bayonet type mounting assembly for releaseably mounting the bushing to the slide.

6. The compensator assembly of claim 5 when said bushing is further provided with a projection having a semi-circular groove for engaging the slidably mounted means to prevent rotational movement of the bushing once it is locked into place in said slide.

7. The compensator assembly of claim 1 wherein said bushing and said compensator weight are both provided with a pair of slots which are co-aligned to enable the escape of expanding gas there through during the firing of the handgun to compensate for the recoil of the handgun which occurs during firing.

8. The compensator assembly of claim 1 wherein said fastening means is formed of a suitable metallic material to further increase the total weight of said compensator weight.

* * * * *

UNITED STATES PATENT AND TRADEMARK OFFICE

CERTIFICATE OF CORRECTION

PATENT NO. : 4,715,140

DATED : December 29, 1987

INVENTOR(S) : Fred Rosenwald

It is certified that error appears in the above-identified patent and that said Letters Patent is hereby corrected as shown below:

IN THE SPECIFICATION:

Column 4, line 25, change "forard" to --forward--.

Column 4, line 27, change "though" to --through--.

Signed and Sealed this

Fourth Day of October, 1988

*Attest:*

*Attesting Officer*

DONALD J. QUIGG

*Commissioner of Patents and Trademarks*